US005385346A

United States Patent [19]

Carroll et al.

[11] Patent Number: 5,385,346

[45] Date of Patent: Jan. 31, 1995

[54] GOLF CLUBS WITH ADJUSTABLE CLUB FACES AND SHAFTS

[76] Inventors: Wilbert E. Carroll; Kathlyn A. Carroll, both of 8201 16th St., Apt. 526, Silver Spring, Md. 20910

[21] Appl. No.: 160,664

[22] Filed: Dec. 2, 1993

[51] Int. Cl.[6] ..... A63B 53/06

[52] U.S. Cl. ..... 273/79; 273/162 R; 273/80 D

[58] Field of Search ..... 273/77 R, 79, 168, 162 R, 273/162 C, 162 D, 162 F, 80 R, 81 R, 75, 32 R, 32 A, 32 B, 32 D, 80 D, 162 A

[56] References Cited

U.S. PATENT DOCUMENTS

| | | | |
|---|---|---|---|
| 651,920 | 6/1900 | Cushing | 273/79 |
| 670,522 | 3/1901 | Thompson | 273/79 |
| 1,634,082 | 6/1927 | Rigby | 273/80 D |
| 1,644,177 | 10/1927 | Collins | 273/79 |
| 1,669,836 | 5/1928 | Neuberth | 273/162 F |
| 1,943,066 | 1/1934 | Ford | 273/79 |
| 2,091,794 | 8/1937 | Pester | 273/80 D |
| 2,179,034 | 11/1939 | Duncan | 273/79 |
| 2,793,862 | 5/1957 | O'Brien | 273/162 C |
| 3,102,726 | 9/1963 | Barrett | 273/80 D |
| 3,524,646 | 8/1970 | Wheeler | 273/80 D |
| 3,774,913 | 11/1973 | Dien | 273/162 D |
| 3,840,231 | 10/1974 | Moore | 273/79 |
| 4,239,216 | 12/1980 | Bauer | 273/32 B |
| 4,540,178 | 9/1985 | Johnson | 273/167 F |

FOREIGN PATENT DOCUMENTS

| | | | |
|---|---|---|---|
| 115874 | 9/1942 | Australia | 273/79 |
| 28759 | 12/1913 | United Kingdom | 273/162 F |

*Primary Examiner*—Sebastiano Passaniti
*Attorney, Agent, or Firm*—Hugh E. Smith

[57] ABSTRACT

A golf club with adjustment capabilities comprising, in combination, a head formed of a support plate having a hosel at its upper end for receiving a shaft and having a horizontal aperture adjacent to the lower end for use in coupling with a face plate, and a face plate having a striking surface with an aperture parallel with the striking surface at the lower extent thereof positionable in axial alignment with the hole in the support plate and a bolt extending through the aperture and hole to couple the face plate at any one of the plurality of angles with respect to the support plate with means on the support plate adjacent to the adjacent edge of the face plate to indicate the angle of the face plate.

1 Claim, 4 Drawing Sheets

GOLF CLUBS WITH ADJUSTABLE CLUB FACES AND SHAFTS

BACKGROUND OF THE INVENTION

Field of the Invention

The present invention relates to golf clubs with adjustable club faces and shafts and more particularly pertains to adjusting the face angle and shaft length of golf clubs.

Description of the Prior Art

The use of adjustable golf clubs is known in the prior art. More specifically, adjustable golf clubs heretofore devised and utilized for the purpose of varying its capabilities are known to consist basically of familiar, expected, and obvious structural configurations, notwithstanding the myriad of designs encompassed by the crowded prior art which has been developed for the fulfillment of countless objectives and requirements.

The prior art discloses a wide variety of golf clubs including adjustment components. For example, U.S. Pat. No. 3,625,613 to Pallmer; U.S. Pat. No. 4,854,582 to Yamana and U.S. Pat. No. 4,948,132 to Waharton disclose golf club heads adjustable with respect to the shaft wherein the coupling intended to be permanent.

U.S. Pat. No. 4,984,794 to Pernelle discloses a golf club capable of selective angle modification between the shaft and head.

In this respect, the golf clubs with adjustable club faces and shafts according to the present invention substantially departs from the conventional concepts and designs of the prior art, and in doing so provides an apparatus primarily developed for the purpose of adjusting the face angle and shaft length of golf clubs.

Therefore, it can be appreciated that there exists a continuing need for new and improved golf clubs with adjustable club faces and shafts which can be used for adjusting the face angle and shaft length of golf clubs. In this regard, the present invention substantially fulfills this need.

SUMMARY OF THE INVENTION

In view of the foregoing disadvantages inherent in the known types of adjustable golf clubs now present in the prior art, the present invention provides improved golf clubs with adjustable club faces and shafts. As such, the general purpose of the present invention, which will be described subsequently in greater detail, is to provide new and improved golf clubs with adjustable club faces and shafts and method which has all the advantages of the prior art and none of the disadvantages.

To attain this, the present invention essentially comprises a golf club with adjustment capabilities comprising, in combination, a head formed of a support plate in a generally V-shaped configuration having a hosel at its upper end for receiving a shaft and having a horizontal aperture adjacent to the lower end for use in coupling with a face plate, a face plate having a striking surface with an aperture parallel with the striking surface at the lower extent thereof positionable in axial alignment with the hole in the support plate and a bolt extending through the aperture and hole to couple the base plate at any one of a plurality of angles with respect to the support plate with means on the support plate adjacent to the adjacent edge of the face plate to indicate the angle of the face plate, a shaft having an upper end with a handle and a lower end coupled to the hosel, the shaft having an upper portion with an upper end and a lower end and having a lower portion with an upper end and a lower end, the upper end of the lower portion positionable within the lower end of the upper portion and secured means therebetween comprising a collar having threads mateable with external threads at the lower end of the upper portion and a compression washer located between the collar, and the lower end of the upper portion whereby tightening of the collar will securely couple the lower portion in a predetermined orientation and further including indicia on the lower portion adjacent to the collar to indicate the length of the club, projections extending outwardly from the support surface and a projection on the adjacent face of the face plate whereby when coupled together rotational movement therebetween is precluded with a coil spring and associated washer resiliently urging together the face plate to the support plate, and an opening located in the upper portion of the shaft beneath the grip adapted to receive therein a rolled up score pad and pencil with tees positioned thereadjacent to the open end of the shaft with a grip located over the handle end of the shaft to close the opening.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved golf clubs with adjustable club faces and shafts which have all the advantages of the prior art adjustable golf clubs and none of the disadvantages.

It is another object of the present invention to provide new and improved golf clubs with adjustable club faces and shafts which may be easily and efficiently manufactured and marketed.

It is further object of the present invention to provide new and improved golf clubs with adjustable club faces and shafts which are of durable and reliable constructions.

An even further object of the present invention is to provide new and improved golf clubs with adjustable club faces and shafts which are susceptible of a low cost of manufacture with regard to both materials and labor, and which accordingly are then susceptible of low prices of sale to the consuming public, thereby making such golf clubs with adjustable club faces and shafts economically available to the buying public.

Still yet another object of the present invention is to provide new and improved golf clubs with adjustable club faces and shafts which provide in the apparatuses and methods of the prior art some of the advantages thereof, while simultaneously overcoming some of the disadvantages normally associated therewith.

Even still another object of the present invention is to adjust the face angles and shaft lengths of golf clubs.

Lastly, it is an object of the present invention to provide new and improved golf club with adjustment capabilities comprising, in combination, a head formed of a support plate having a hosel at its upper end for receiving a shaft and having a horizontal aperture adjacent to the lower end for use in coupling with a face plate, and a face plate having a striking surface with an aperture parallel with the striking surface at the lower extent thereof positionable in axial alignment with the hole in the support plate and a bolt extending through the apertures to couple the face plate at any one of a plurality of angles with respect to the support plate with means on the support plate adjacent to the adjacent edge of the face plate to indicate the angle of the face plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
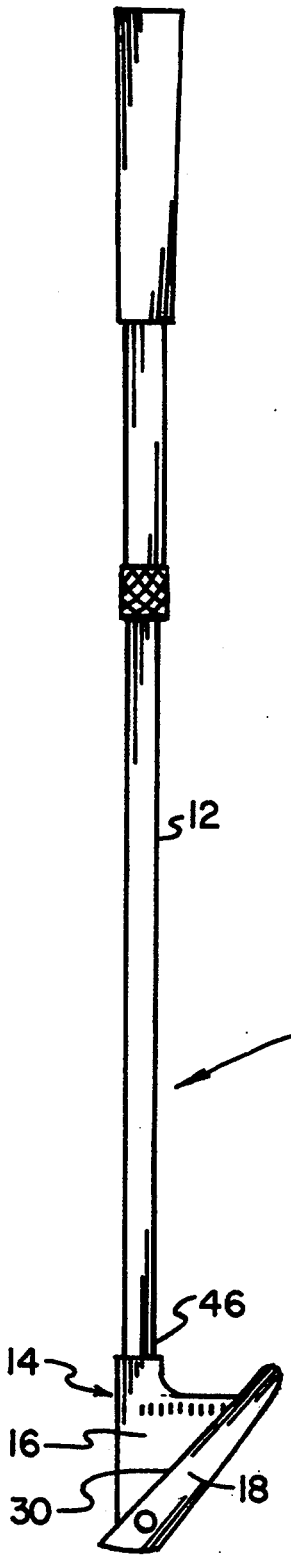
FIG. 1 is a side elevational view of a golf club with adjustable club face and shaft constructed in accordance with the principles of the present invention.
Figure 2:
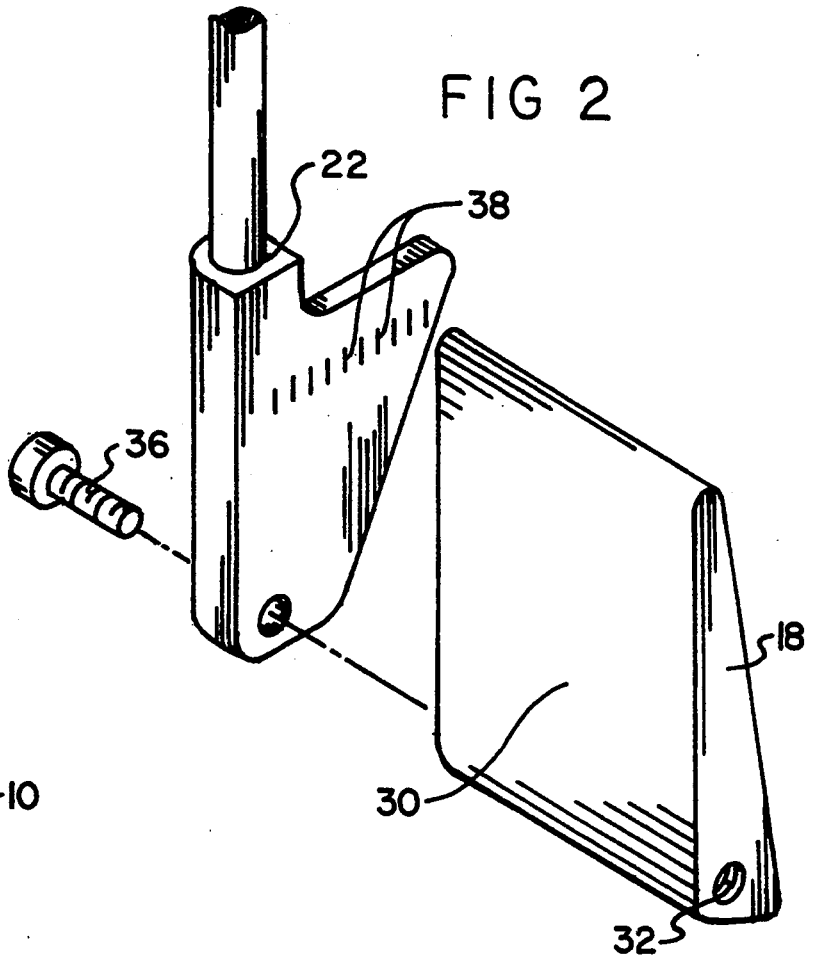
FIG. 2 is an exploded perspective view of the coupling of the face plate to the support plate at the lower end of the shaft.
Figure 4:
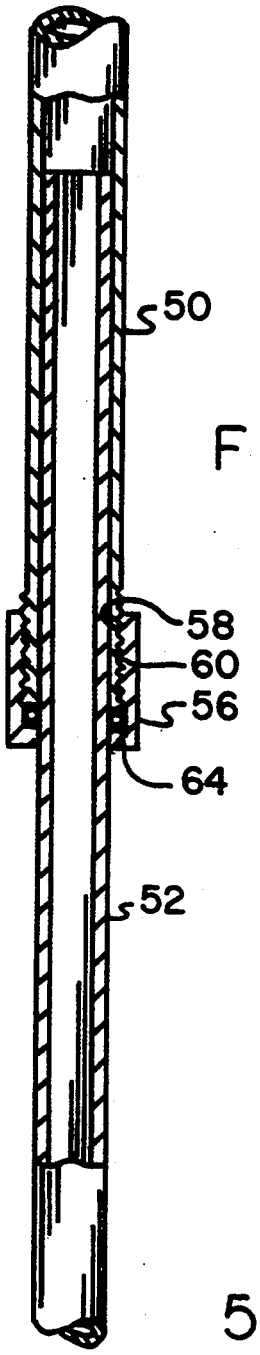
FIG. 4 is a sectional view of the upper portion of the shaft taken along line 5—5 of FIG. 4.
Figure 3:
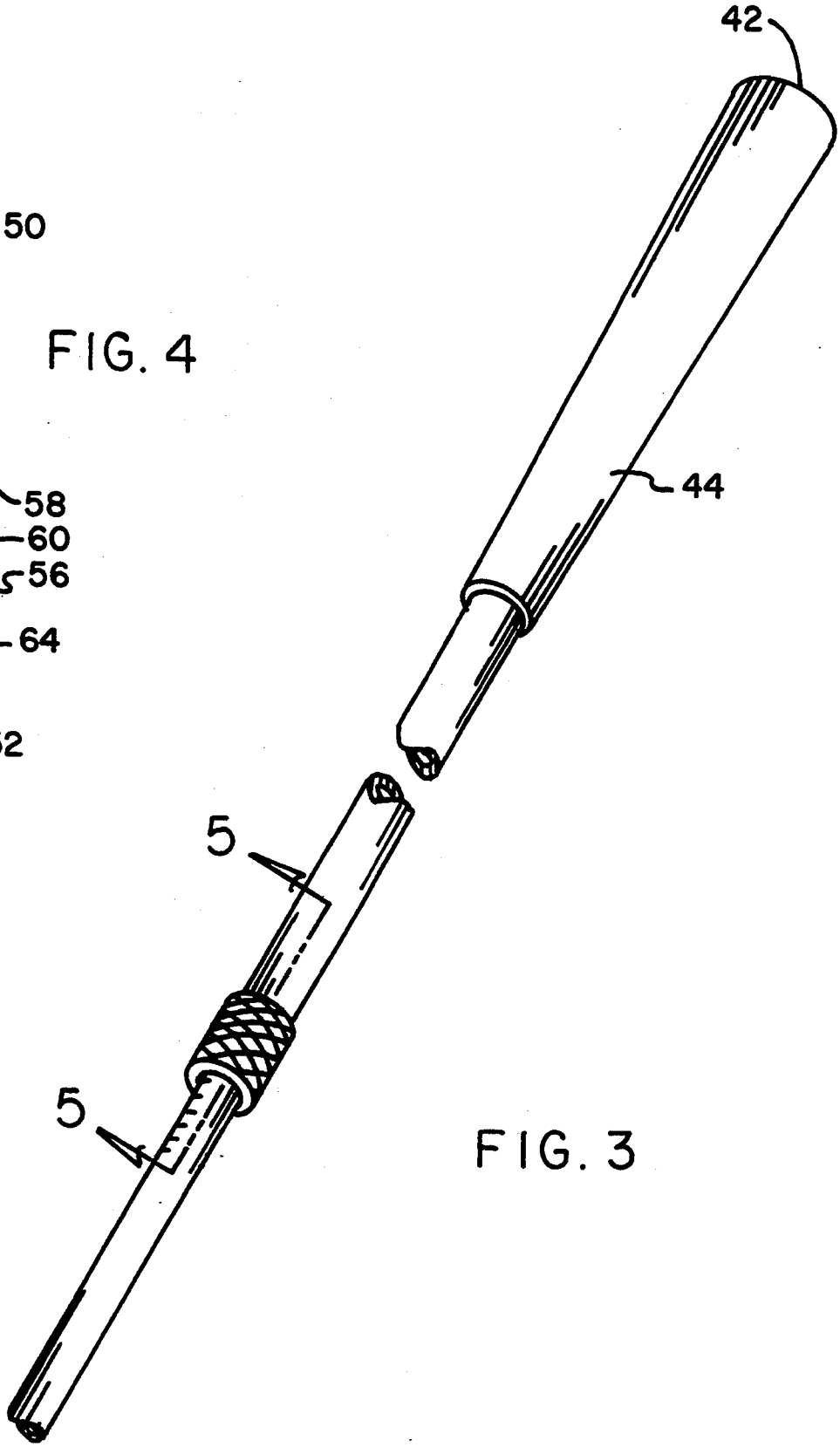
FIG. 3 is a perspective view of the upper portion of the shaft showing the shaft adjustment mechanisms.

With reference now to the drawings, and in particular to FIG. 1 thereof, the preferred embodiment of the new and improved golf clubs with adjustable club faces and shafts embodying the principles and concepts of the present invention and generally designated by the reference numeral 10 will be described.

More specifically, it will be noted in the various Figures, particularly FIGS. 1 through 4, that the golf club 10 with adjustment capabilities comprises, two major components, the shaft 12 and the head 14. The head includes a support plate 16 and a face plate 18. The support plate 16 is formed in a generally V-shaped configuration. It has a hosel 22 at its upper end for receiving a shaft. It has a horizontal hole 24 adjacent to its lower end for use in coupling with a face plate 18.

The face plate 18 has a striking surface 30 with a hole 32 parallel with the striking surface at the lower extent thereof. The hole 32 is positionable in axial alignment with the hole 24 in the support plate 16.

Coupling between the two plates 16 and 18 is through a bolt 36 extending through the holes 24 and 32 to couple the base plate at any one of the plurality of angles with respect to the support plate. Indicia 38 is on the support plate adjacent to the adjacent edge of the face plate. Such indicia indicates the angle of the face plate.

The shaft 12 has an upper end 42 with a grip 44. It also a lower end 46 coupled to the hosel 22. The shaft is formed of an upper portion 50 with an upper end and a lower end and a lower portion 56 with an upper end and a lower end. The upper end of the lower portion is positionable within the lower end of the upper portion.

Securement mechanisms between the portion of the shaft comprise a collar 56 having threads 58 mateably with external threads 60 at the lower end of the upper portion of the shaft. A compressional washer 64 is located between the collar, lower end of the upper portion and the lower portion. Tightening of the collar will compress the washer and securely couple the lower portion in a predetermined orientation with respect to the upper portion. Further included is indicia on the lower portion adjacent to the collar to indicate the length of the club.

Figure 6:
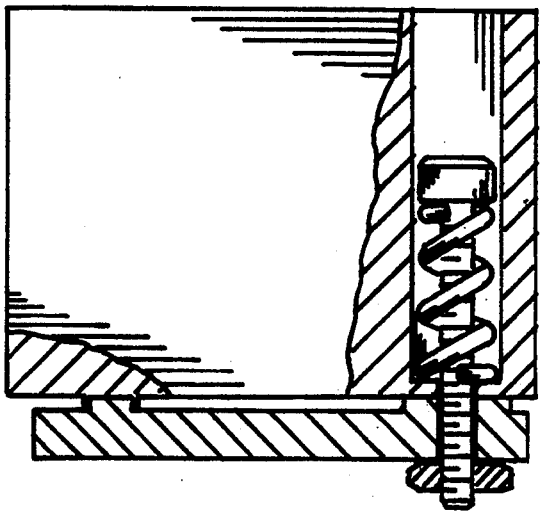
FIG. 6 is a sectional view of the coupling between the support plate and face plate.
Figure 5:
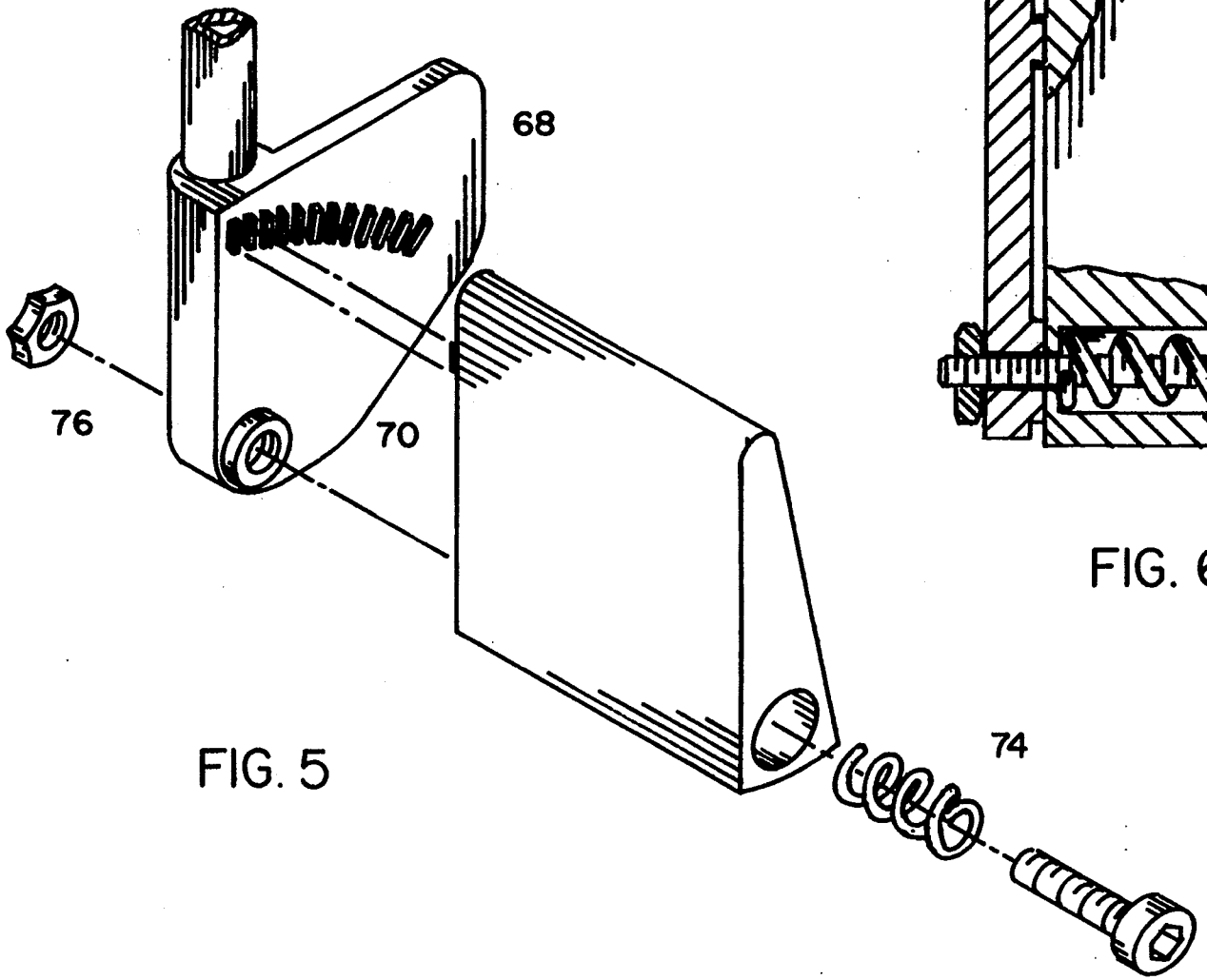
FIG. 5 is a perspective view of the lower portion of a shaft showing a coupling between the support plate and the face plate constructed in accordance with an alternate embodiment of the invention.

In an alternate embodiment of the invention, as shown in FIGS. 5 and 6, projections 68 extend outwardly from the support plate 16. A projection 70 on the adjacent face of the face plate 20 functions to couple together the plates against rotational movement therebetween. Such rotation is further precluded by a coil spring 74 and associated nut 76 resiliently urging together the face plate to the support plate.

Figure 7:
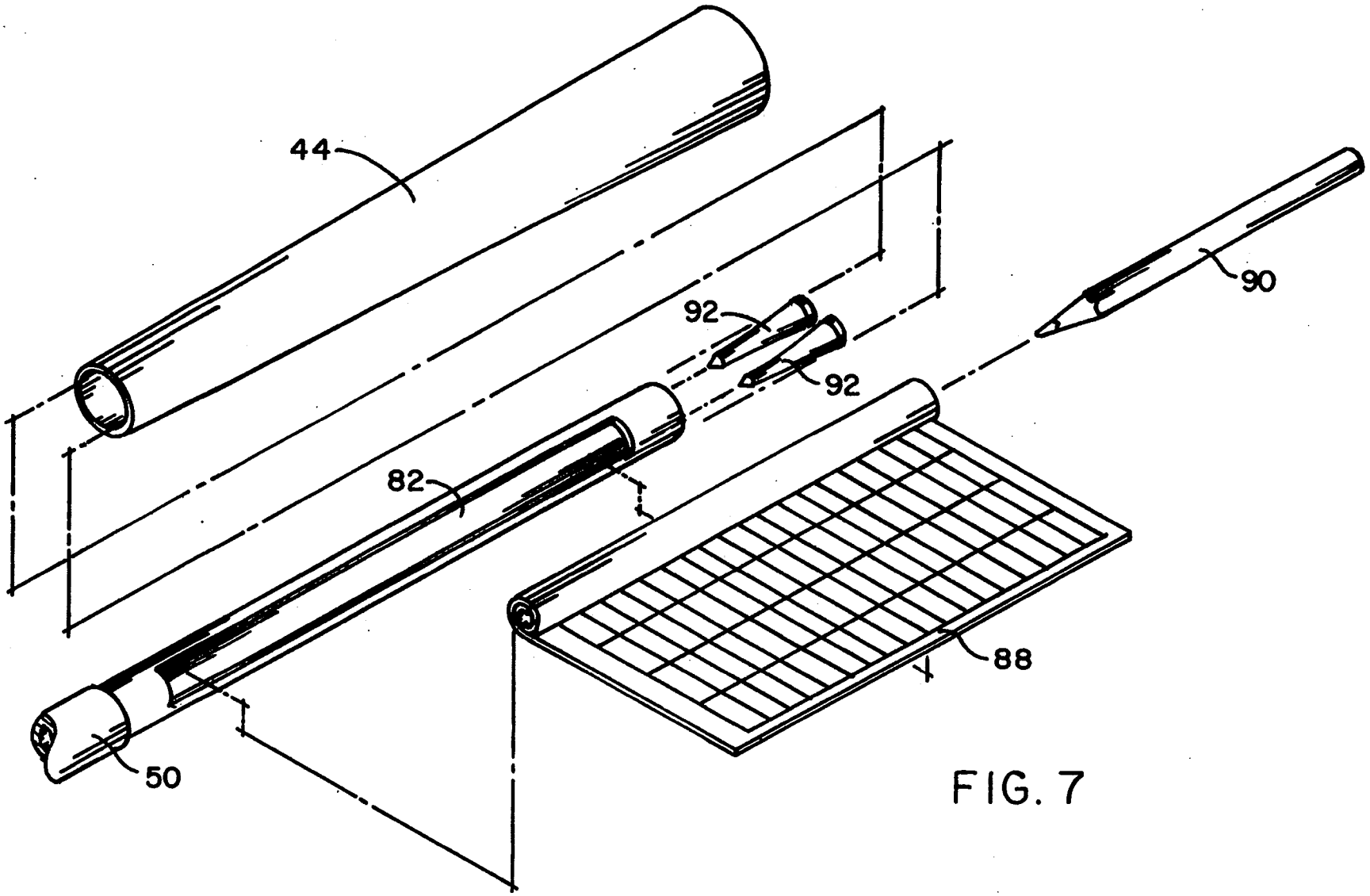
FIG. 7 is an exploded perspective view of the handle portion with the grip removed.

In the FIG. 7 embodiment, a slot 82 is located in the upper portion of the shaft beneath the grip 44. Such slot is adapted to receive therein a rolled up scroll pad 88 and pencil 90 with tees 92 positioned there adjacent to the open end of the shaft with a grip located over the handle end of the shaft to close the opening.

The present invention provides a single golf club which is adjustable so it can be used as a set of irons, ranging from the one through the nine, as well as a pitching wedge, sand wedge and putter. A full set of irons consist of twelve individual clubs listed above. The twelve clubs are needed because it is designed and made the golf ball go higher and for a shorter distant than the preceding one. The one iron hits the ball the farthest distance, but at the lowest height. The pitching edge imparts the highest projectary, but at the shorted distance, with the others in between following this pattern. The sand wedge is set a very flat angle so the ball can clear the slope of the sand traps. Putters have almost a vertical face because they are intended to only roll the ball on the putting range. The shafts of the clubs also very progressively, with the one iron being the longest and the sand wedge being the shortest.

The present invention consists of a telescoping shaft and hosel, to which is pinned a club head. The club head may be set at any twelve angles relative to the shaft, to become any of twelve irons and the shaft length is adjusted. Graduations are provided on the head, and the reference mark is on the hosel to show the iron number the head has been set. The shaft lengths are similarly marked. After the settings have been made, the bolt is tightened securely and the club is set to serve its master. The hollow shaft is used to store pins, score pad and tees.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf club with adjustment capabilities comprising, in combination:

a head formed of a support plate in a generally V-shaped configuration having a hosel at an upper end for receiving a shaft and having a horizontal aperture adjacent to a lower end for use in coupling with a face plate;

a face plate having a striking surface with an aperture parallel with the striking surface at a lower extent thereof positionable in axial alignment with the horizontal aperture in the support plate and a bolt extending through both said apertures to couple the face plate at any one of a plurality of angles with respect to the support plate with means on the support plate adjacent to the adjacent edge of an face plate to indicate the angle of the face plate;

a shaft having an upper end with a handle and a lower end coupled to the hosel, the shaft having an upper portion with an upper end and a lower end and having a lower portion with an upper end and a lower end, the upper end of the lower portion positionable within the lower end of the upper portion and secured means therebetween comprising a collar having threads mateable with external threads at the lower end of the upper portion and a compression washer located between the collar and the lower end of the upper portion whereby tightening of the collar will securely couple the lower portion in a predetermined orientation and further including indicia on the lower portion adjacent to the collar to indicate the length of the club;

projections extending outwardly from the support surface and a projection on the adjacent edge of the face plate whereby when coupled together rotational movement therebetween is precluded and further including a coil spring and associated washer resiliently urging together the face plate to the support plate; and an opening located in the upper portion of the shaft adapted to receive therein a rolled up score pad and pencil with tees positioned thereadjacent to the opening with a grip located over the handle of the shaft to close the opening.

* * * * *